United States Patent [19]

Seto et al.

[11] Patent Number: 4,797,984

[45] Date of Patent: Jan. 17, 1989

[54] SEAT BELT BUCKLE

[75] Inventors: Toshiaki Seto; Masaru Morinaga, both of Kanagawa, Japan

[73] Assignee: Nippon Seiko Kabushiki Kaisha, Tokyo, Japan

[21] Appl. No.: 68,344

[22] Filed: Jul. 1, 1987

[30] Foreign Application Priority Data

Jul. 7, 1986 [JP] Japan ..... 61-103115[U]

[51] Int. Cl.[4] ..... A44B 11/25

[52] U.S. Cl. ..... 24/641; 24/645

[58] Field of Search ..... 280/801; 297/468; 24/636–639, 640–642, 633, 645, 664

[56] References Cited

U.S. PATENT DOCUMENTS

| | | | |
|---|---|---|---|
| 4,127,922 | 12/1978 | Mita | 24/637 |
| 4,182,008 | 1/1980 | Pouget . | |
| 4,310,952 | 1/1982 | Robben et al. | 24/641 |
| 4,377,888 | 3/1983 | Ikesue | 24/637 |
| 4,384,391 | 5/1983 | Lindblad et al. . | |
| 4,394,792 | 7/1983 | Schmidt | 24/637 |
| 4,450,604 | 5/1984 | Oowada . | |
| 4,451,958 | 6/1984 | Robben et al. | 24/664 X |
| 4,454,634 | 6/1984 | Haglund et al. . | |
| 4,543,693 | 10/1985 | Cunningham | 24/641 |
| 4,550,474 | 11/1985 | Doty et al. . | |
| 4,575,907 | 3/1986 | Takada . | |

FOREIGN PATENT DOCUMENTS

| | | | |
|---|---|---|---|
| 0071013 | 2/1983 | European Pat. Off. . | |
| 2423176 | 11/1979 | France . | |
| 2553638 | 4/1985 | France | 24/633 |

*Primary Examiner*—Kenneth J. Dorner
*Assistant Examiner*—James R. Brittan
*Attorney, Agent, or Firm*—Wegner & Bretschneider

[57] ABSTRACT

A buckle is constructed of a base, latch piece, holding member and release member. The base has a bottom wall and side walls defining substantially L-shaped holes. The latch piece is supported on the base rockingly between a tongue latching position and a tongue non-latching position. The holding member is received at both end portions in the holes displaceably between a holding position, where the end portions are in the horizontal portions of the corresponding holes so as to hold at the latching position the latch piece which has been in the latching position, and a non-holding position where the end portions are in the vertical portions of the corresponding holes so as to permit movement of the latch piece from the latching position. The release member is provided displaceably between a non-operated position and an operated position and adapted to bring the holding member to the non-holding position and the latch piece to the non-latching position when the release member assumes the operated position.

7 Claims, 3 Drawing Sheets

SEAT BELT BUCKLE

BACKGROUND OF THE INVENTION

1. Field of the Invention

This invention relates to a buckle having an improved tongue-holding function, which is suitable for use, for example, in a vehicle seat belt.

2. Description of the Prior Art

As buckles equipped with a holding member such as a pin for holding at a tongue latching position a latch piece on which an associated tongue is latched, several types of buckles have been proposed to date. Reference may be had, for example, to the following U S. Pat. Nos.: 4,182,008 01/08/80 Rene Pouget; 4,384,391 05/24/83 Stig M. Lindblad et al.; 4,450,604 05/29/84 Tetsuya Oowada; 4,454,634 06/19/84 Lennart Haglund et al.; 4,575,907 03/18/86 Juichiro Takada;

SUMMARY OF THE INVENTION

An object of this invention is to enhance the tongue-holding functions of buckles of the abovementioned types.

In one aspect of this invention, there is provided a buckle comprising:

a base having a bottom wall portion and side wall portions extending upright in a face-to-face relation from both side edges of the bottom wall portion respectively, said side wall portions defining substantially L-shaped holes therethrough;

a latch piece supported on the side wall portions of the base rockingly between a tongue latching position and a tongue non-latching position;

a holding member received at both end portions thereof in the substantially L-shaped holes, said holding member being displaceable between a holding position, where the end portions of the holding member are in the horizontal hole portions of the corresponding L-shaped holes so as to hold at the tongue latching position the latch piece which has been in the tongue latching position, and a non-holding position where the end portions of the holding member are in the vertical hole portions of the corresponding L-shaped holes so as to permit movement of the latch piece from the tongue latching position; and a release member provided displaceably between a non-operated position and an operated position and adapted to bring the holding member to the non-holding position and the latch piece to the tongue non-latching position when the release member assumes the operated position, said release member having a means for covering the vertical hole portion of at least one of the L-shaped holes so as to prevent the holding member from moving to the non-holding position when the holding member assumes the holding position.

In another aspect of this invention, there is also provided a buckle comprising:

a base having a bottom wall portion and side wall portions extending upright in a face-to-face relation from both side edges of the bottom wall portion respectively, said side wall portions defining inverted T-shaped recesses communicating the outside at upper portions thereof;

a latch piece supported on the base dispaceably between a tongue latching position and a tongue non-latching position;

a holding member provided displaceably between a holding position, where the holding member holds at the tongue latching position the latch piece which has been in the tongue latching position, and a non-holding position where the holding member permits movement of the latch piece from the tongue latching position; and a release member provided displaceably between a non-operated position and an operated position and adapted to bring the holding member to the non-holding position and the latch piece to the tongue non-latching position when the release member assumes the operated position, said release member having a pair of projections which are received in the horizontal recess portions of the corresponding inverted T-shaped recesses.

In a further aspect of this invention, there is also provided a buckle comprising:

a base;

a latch piece supported on the base displaceably between a tongue latching position and a tongue non-latching position;

a holding member provided displaceably between a holding position, where the holding member holds at the tongue latching position the latch piece which has been in the tongue latching position, and a non-holding position where the holding member permits movement of the latch piece from the tongue latching position;

a release member provided displaceably in a direction parallel to the direction of insertion and ejection of an associated tongue between a non-operated position and an operated position and adapted to bring the holding member to the non-holding position and the latch piece to the tongue non-latching position when the release member assumes the operated position, said release member having a finger-operated surface (8a) on a trailing side thereof relative to the direction of insertion of the tongue; and a cover member defining an opening the surrounding edge of which is closed, said opening permitting operation of at least the operated surface, the outer end of said surrounding edge of said opening lying in substantially the same plane as the operated surface.

According to the present invention, a holding member is provided and moreover, the movement of the holding member is controlled. The tongue-holding function is hence enhanced.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENT

Figure 1:
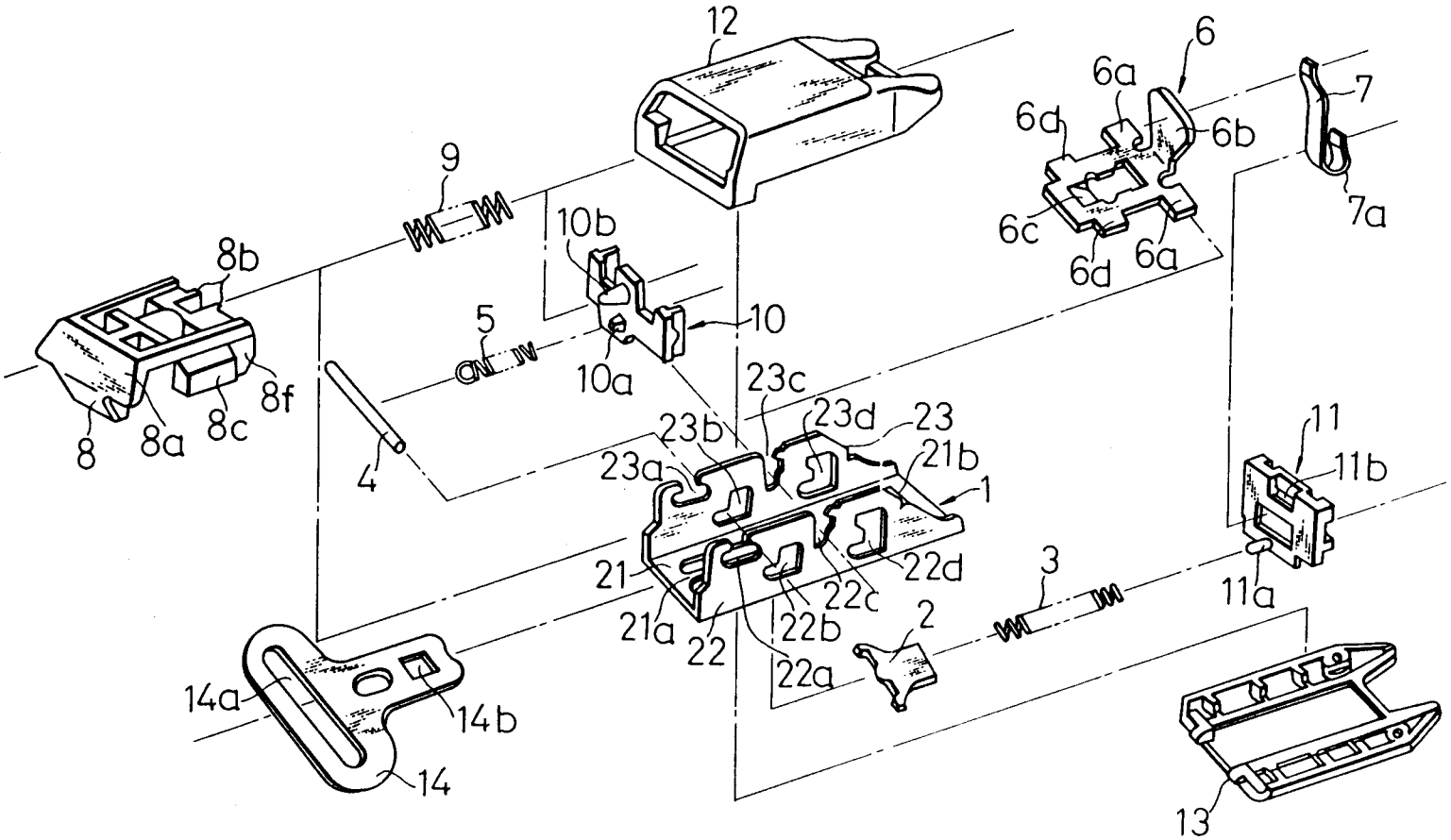
FIG. 1 is an exploded perspective view of a buckle according to one embodiment of this invention.

Referring first to FIG. 1, a base has a bottom wall portion 21 and a pair of side wall portions 22,23 extending upright in a face-to-face relation from both side edges of the bottom wall portion respectively The bottom wall portion 21 defines a guide portion 21*a*, which supports a tongue ejecting slider 2 slidably between an advanced position and a retreated position, and a webbing fastening slot 21*b*. A push-out spring 3, which urges the slider 2 toward the advanced position, extends externally along a rear (right-hand, as viewed in FIG. 1) portion of the guide portion 21*a*.

In the side wall portions 22,23, there are respectively formed in order from the front (from the left as viewed in FIG. 1) T-shaped recesses 22*a*,23*a* preventing the separation of a release button 8, L-shaped holes 22*b*,23*b* for guiding a pin 4, attachment notches 22*c*,23*c* for a spring supporting plate 10, and support openings 22*d*,23*d* for a latch piece 6.

The pin 4 serves as a holding member and extends through the L-shaped holes 22*b*,23*b* with both end portions projecting out through the side wall portions 22,23. The pin 4 is urged frontwardly toward a holding position by means of a pin guide spring 5 which is attached at the front extremity thereof to the pin 4.

A pair of ear portions 6*a*,6*a* of the L-shaped latch piece 6 are inserted in the support openings 22*d*,23*d* respectively, whereby the latch piece 6 is supported rockingly about an imaginary axis connecting the paired ear portions 6*a*. The latch piece 6 is biased toward a tongue latching position, i.e., a downwardly rocked position by means of a latch spring 7 as a biasing member.

On the side wall portions 22,23 of the base 1, the release button 8 is mounted as a release member slidably along the length of the buckle. The button 8 has an operated surface 8*a*, latch piece operating portions 8*b* which are brought into contact with an upright portion 6*b* of the latch piece 6, a pair of pin operating portions 8*c* covering both end portions of the pin 4, and a pair of projections 8*d* extending in the T-shaped recesses 22*a*,23*b* respectively (not shown in FIG. 1; see FIG. 6). The release button 8 is biased toward a front position, i.e., a non-operated position by a coil spring 9.

Inside the attachment notches 22*c*,23*c*, the spring supporting plate 10 is secured fixedly. The spring supporting plate 10 has a small bead 10*a* and a large bead 10*b* on the front wall thereof. A rear end portion of the pin guide spring 5 is supported on the small bead 10*a*, while a rear end portion of the coil spring 9 is supported on the large bead 10*b*.

A latch spring guide 11 is provided fixedly at the rear end of the guide portion 21*a* of the bottom wall portion 21. The latch spring guide 11 includes a bead 11*a* provided on the front wall thereof. A rear end portion of the push-out spring 3 is fit on the bead 11*a* so that the push-out spring 3 is supported by the latch spring guide 11. A tail portion 7*a* of the latch spring 7 extends in the form of S along a guide portion 11*b*, whereby the latch spring 7 is carried on the latch spring guide 11.

Covering the above-described members except for the operated surface 8*a* of the release button 8 and an insertion opening for a tongue 14, an upper cover 12 and lower cover 13 are provided.

The tongue 14 defines a webbing through-slot 14*a* and a square hole 14*b*. When the tongue 14 is inserted between the bottom wall portion 21 of the base 1 and the latch piece 6, a downwardly-projecting latching portion 6engages the square hole 14*b* so as to achieve latching of the tongue.

Figure 2:
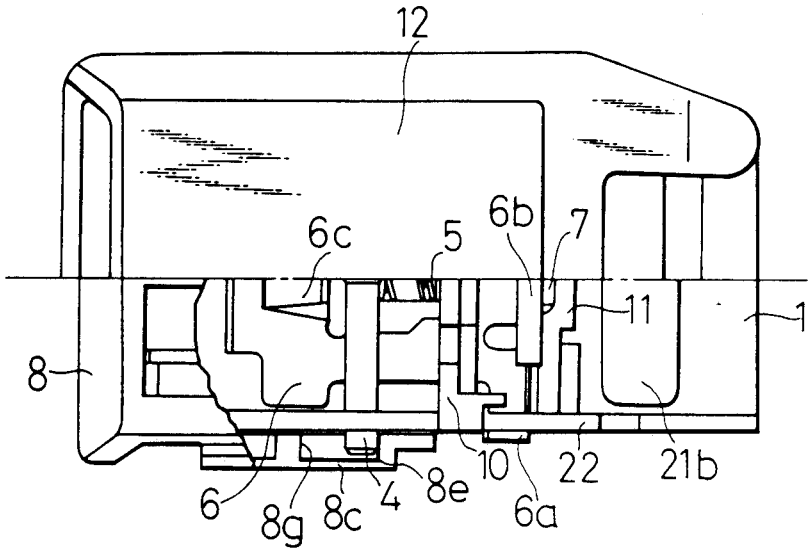
FIGURE 2 is a partly cut-off plan view of the buckle.
Figure 3:
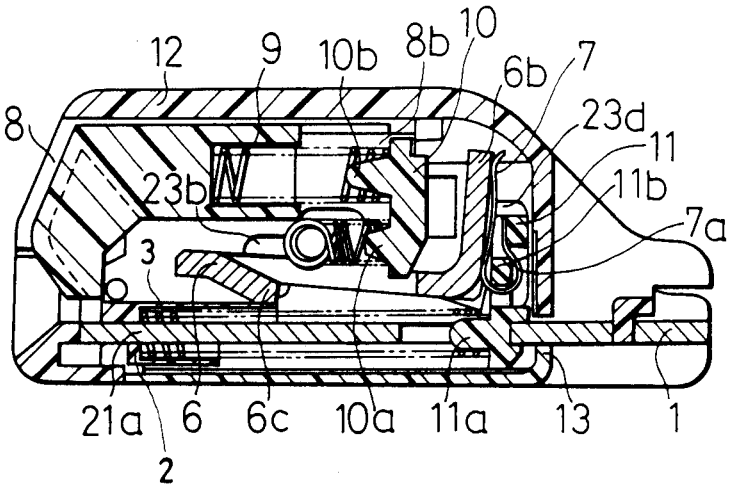
FIG. 3 is a cross-sectional view of the which is in a non-latching state.

The buckle is shown in an assembled form in FIGS. 2 and 3.

The operation of the buckle of the abovedescribed structure will next be described.

In the tongue non-latching state depicted in FIGS. 2 and 3, the slider 2 is urged frontward by the spring 3 so that the slider 2 assumes an advanced position set near the tongue inserting opening and holds the latch piece 6 at the tongue non-latching position. The release button 8 is also urged frontward by the coil spring 9 and assumes the non-operated position. Since the pin 4 located at the non-holding position is brought into contact with inner rear walls 8*e* of the pin operating portion 8*c* of the release button 8 (see FIG. 2), the release button 8 is not at the non-operated position where the release button 8 has been slid fully frontward.

When the tongue 14 is inserted gradually into the buckle in the state shown in FIG. 3, the tongue 14 first of all begins to push the slider 2 toward the retreated position. When the tongue 14 has been inserted fully, the slider 2 which has already stopped holding of the latch piece 6 since sometime ago reaches completely to the retreated position and at the same time, the square hole 14*b* of the tongue 14 assumes a position right underneath the latching portion 6*c* of the latch piece 6. Then, the latch piece 6 which has been urged toward the tongue latching position falls from the tongue non-latching position to the tongue latching position and at the same time, the pin which has been urged toward the holding position moves to the front holding position. At the same time, the release button 8 moves frontward completely, namely, to the non-operated position because the above-described holding of the release button 8 by the pin 4 is released.

Figure 4:
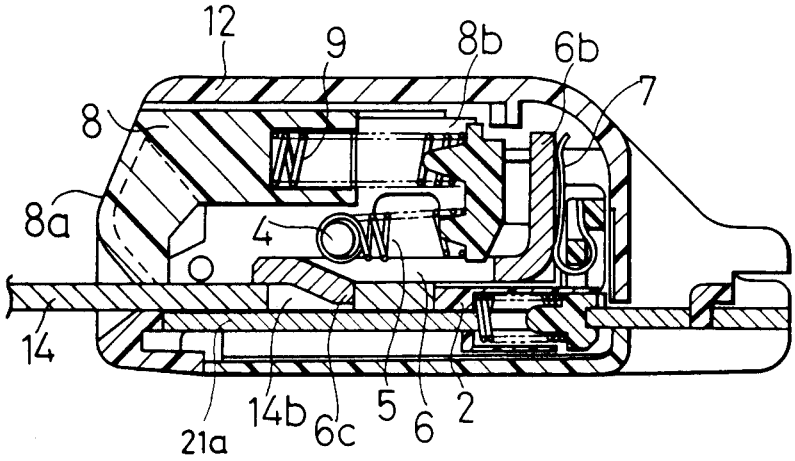
FIG. 4 is a cross-sectional view of the buckle which is in a tongue latching state.
Figure 5:
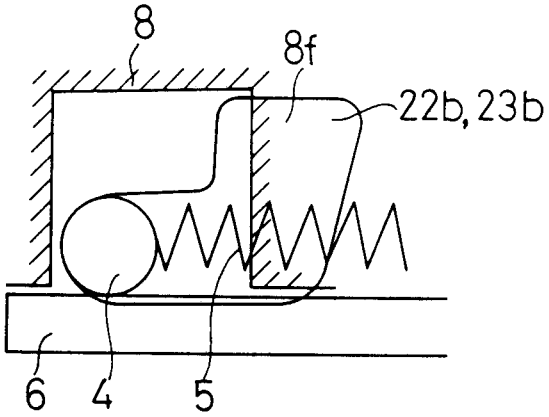
FIG. 5 illustrates the function of rear side portions of a release button.

This tongue latching state is illustrated in FIG. 4. Owing to the provision of the pin 4, a tongue latching state has been achieved that the latch piece 6 is prevented without failure from jumping up to the tongue non-latching position.

In this state, rear side portions 8*f* (see FIG. 1) of the release button 8 which has reached the frontmost position cover rear portions of the corresponding L-shaped holes 22*b*,23*b*. The pin 4 is therefore prevented from moving rearwardly and upwardly to the non-holding position even if a force is applied to cause the pin 4 to move toward the non-holding position by a collision or the like. Accordingly, the prevention of accidental release of the tongue 14 is ensured further.

Since the upper cover 12 extends fully in the frontward direction to a position substantially equal to the upper edge of the operated surface 8*a* of the release button 8, the release button 8 is not brought to the operated position thereof unless it is intentionally pushed in, namely, rearwardly to the operated position by a finger or the like. More specifically, the upper cover 12 is shaped and dimensioned, for example, in such a manner that the tongue 14 is not unlatched from the latch piece 6 even when a ball having a diameter of 28 mm is pressed against the operated surface 8*a* of the release button 8 while maintaining the ball in contact with the upper surface of the tongue 14. The latching of the tongue 14 is hence not released unintentionally even if the operated surface 8*a* is pressed accidentally by an elbow or the like.

In order to release the latching of the tongue 14, it is necessary to push the release button 8 rearwardly to the operated position. Then, inner front walls 8*g* (see FIG. 2) of the pin operating portions 8*c* of the release button 8 are firstly brought into contact with the pin 4 so that the pin 4 is caused to move toward the non-holding position. The latch piece operating portions 8*b* thereafter press the upright portion 6*b* of the latch piece 6, whereby the lock portion 6*c* of the latch piece 6 is rocked upwardly to the tongue non-latching position. As a result, the pin 4 is pressed against the inner corners of the L-shaped holes 22*b*,23*b* to assume the non-holding position as shown in FIG. 3. At this time, the slider 2 is pushed to the advanced position so that the tongue 14 is ejected.

As appreciated from FIG. 3, the slider 2 which assumes the advanced position is located near the tongue insertion opening so as to prevent foreign objects from entering the buckle through the tongue insertion opening in cooperation with a lower part of a front end portion of the release button 8.

As also envisaged from FIG. 4, the imaginary central axis (which is substantially the same as the line connecting both ear portions 6*a*) of rocking motion of the latch piece 6 is located rear the lock portion 6*c* and the lock portion 6*c* projects downwardly. When one tries to pull out the tongue 14, a torque is produced in a direction such that the latch piece 6 is brought toward the tongue non-latching position. The release of the tongue 14 is hence facilitated. Accordingly, the releasability of the tongue 14 has been improved.

Between the paired side walls 22,23, the latch piece 6 has the broadest width at tabs 6*d*,6*d* (see FIG. 1). The paired side wall portions 22,23 are provided with an interval slightly broader than the distance between the longitudinal edges of the tabs 6*d*,6*d* of the latch piece 6. This dimensional relationship is effective for the elimination of excess lateral play of the latch 6.

Figure 6:
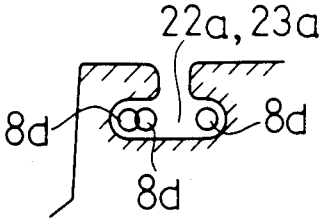
FIG. 6 shows the function of projections of the release button.

As illustrated schematically in FIG. 6, the projections 8*d* are provided with the release button 8 and are inserted in the T-shaped recesses 22*a*,23*a* of the base 1. Even if the cover 12 should be broken upon application of an impact, the projections 8*d* prevent the release button 8 from separating from the base 1 so as to ensure the maintenance of the principal function of the buckle. In FIG. 6, the projection 8*d* assumes the rightmost position when the release button 8 is at the operated position. In the tongue non-latching state shown in FIG. 3, the projection 8*d* assumes a left-hand intermediate position. In the tongue latching position depicted in FIG. 4, the projection assumes the leftmost position.

Having now fully described the invention, it will be apparent to one of ordinary skill in the art that many changes and modifications can be made thereto without departing from the spirit or scope of the invention as set forth herein.

We claim:

1. A buckle comprising:

a base having a bottom wall portion and side wall portions extending upright in a face-to-face relation from opposing side edges of the bottom wall portion respectively, said side wall portions defining substantially L-shaped holes therethrough, each of said substantially L-shaped holes having a horizontal portion which extends essentially parallel to the bottom wall portion, and a vertical portion which extends essentially perpendicular to the bottom wall portion;

a latch piece supported on the side wall portions of the base rockingly between a tongue latching position and a tongue non-latching position;

a holding member received at both end portions thereof in the substantially L-shaped holes, said holding member being displaceable between a holding position, where the end portions of the holding member are in the horizontal portions of the corresponding L-shaped holes so as to hold at the tongue latching position the latch piece which has been in the tongue latching position, and a non-holding position where the end portions of the holding member are in the vertical portions of the corresponding L-shaped holes so as to permit movement of the latch piece from the tongue latching position;

a first spring for biasing the holding member toward the holding position;

a release member slidably mounted on said base and displaceable between a non-operated position and an operated position and adapted to bring the holding member to the non-holding position and the latch piece to the tongue non-latching position when the release member assumes the operated position, said release member comprising a means for covering substantially an entire part of the vertical portion of at least one of the L-shaped holes so as to prevent the holding member form moving to the non-holding position when the holding member assumes the holding position; and a second spring for biasing the release member toward the non-operated position.

2. The buckle as claimed in claim 1, wherein the release member is additionally equipped with a means for causing the latch piece to rock to the tongue non-latching position when the end portions of the holding member are located respectively in the regions where the horizontal portions and vertical portions of the corresponding L-shaped holes meet together.

3. The buckle as claimed in claim 1, wherein a latch piece is biased by a biasing means toward the tongue latching position.

4. The buckle as claimed in claim 1, further comprising a slider for ejecting the tongue, which has been latched by the latch piece, as soon as the release member is brought to the operated position, said slider being displaceable between an advanced position which the slider assumes after ejection of the tongue and a retreated position which the slider assumes after insertion of the tongue into the buckle and latching of the tongue on the latch piece and being biased toward the advanced position.

5. The buckle as claimed in claim 4, wherein the advanced position of the slider is set near a tongue inserting opening.

6. The buckle as claimed in claim 1, wherein an associated tongue is inserted between the latch piece and the bottom wall portion and the latch piece engages the tongue at a latching portion extending downwardly toward the bottom wall portion so as to latch the tongue.

7. The buckle as claimed in claim 1, wherein the latch piece has an L-shaped cross-section when taken along an axis parallel to both the bottom wall portion and the side wall portions.

* * * * *